US007451810B2

(12) United States Patent
Jackson et al.

(10) Patent No.: US 7,451,810 B2
(45) Date of Patent: Nov. 18, 2008

(54) KICKOVER TOOL AND SELECTIVE MANDREL SYSTEM

(75) Inventors: Elijah D. Jackson, Mandeville, LA (US); Michael S. Lane, Palmer, AK (US); Tyson Messick, Bartlesville, OK (US); Kenneth C. Burnett, III, Bartlesville, OK (US)

(73) Assignee: Schlumberger Technology Corporation, Sugar Land, TX (US)

( * ) Notice: Subject to any disclaimer, the term of this patent is extended or adjusted under 35 U.S.C. 154(b) by 250 days.

(21) Appl. No.: 11/308,875

(22) Filed: May 18, 2006

(65) Prior Publication Data

US 2007/0267200 A1 Nov. 22, 2007

(51) Int. Cl.
*E21B 23/03* (2006.01)

(52) U.S. Cl. ..... 166/117.5; 166/242.5

(58) Field of Classification Search ..... 166/117.5, 166/386, 332.5, 242.5
See application file for complete search history.

(56) References Cited

U.S. PATENT DOCUMENTS

| | | | | |
|---|---|---|---|---|
| 2,892,415 | A | | 6/1959 | McGowen, Jr. |
| 2,914,078 | A | | 11/1959 | McGowen, Jr. |
| 3,086,593 | A | | 4/1963 | Chitwood |
| 3,741,299 | A | | 6/1973 | Terral |
| 3,760,832 | A | | 9/1973 | McGowen, Jr. |
| 3,788,397 | A | | 1/1974 | Terral et al. |
| 3,874,445 | A | | 4/1975 | Terral |
| 3,891,032 | A | | 6/1975 | Tausch et al. |
| 4,002,203 | A | | 1/1977 | Terral |
| 4,111,608 | A | | 9/1978 | Elliott |
| 4,169,505 | A | | 10/1979 | Neal |
| 4,239,082 | A | | 12/1980 | Terral |
| 4,294,313 | A | * | 10/1981 | Schwegman ..... 166/117.5 |
| 4,441,519 | A | | 4/1984 | Terral |
| 4,454,913 | A | | 6/1984 | Guidry et al. |
| 4,541,482 | A | | 9/1985 | Johnston |
| 4,640,350 | A | | 2/1987 | Akkerman |
| 4,865,125 | A | | 9/1989 | De Cuir |
| 4,976,314 | A | | 12/1990 | Crawford |
| 5,022,427 | A | | 6/1991 | Churchman et al. |
| 5,048,610 | A | | 9/1991 | Ross et al. |
| 5,113,939 | A | | 5/1992 | Ross et al. |
| 5,483,988 | A | | 1/1996 | Pringle |

(Continued)

FOREIGN PATENT DOCUMENTS

| | | |
|---|---|---|
| GB | 2244504 A | 12/1991 |

(Continued)

*Primary Examiner*—Kenneth Thompson
(74) *Attorney, Agent, or Firm*—Clarence E. Eriksen & Associates, P.C.; Kevin B. McGoff; Bryan P. Galloway

(57) ABSTRACT

A kickover tool is disclosed for installing and retrieving a well flow control device from a side pocket mandrel in a wellbore. The kickover tool includes a spring-loaded key which has an outer circumferential surface having a predetermined machined pattern formed therein. Each side pocket mandrel in the tubing string contains a profile having a predetermined machined pattern. The spring-loaded key will engage the side pocket mandrel with a profile matching the pattern on the outer circumferential surface of the spring-loaded key. When that engagement occurs, the articulated arm of the kickover tool is permitted to be deployed to insert a well flow control device in the side pocket of the side pocket mandrel.

5 Claims, 8 Drawing Sheets

U.S. PATENT DOCUMENTS

| | | | | |
|---|---|---|---|---|
| 5,515,880 | A | 5/1996 | Pringle | |
| 5,862,859 | A | 1/1999 | Speed | |
| 5,971,004 | A | 10/1999 | Pringle | |
| RE36,566 | E | 2/2000 | Pringle | |
| 6,068,015 | A | 5/2000 | Pringle | |
| 6,070,608 | A | 6/2000 | Pringle | |
| 6,082,455 | A | 7/2000 | Pringle | |
| 6,148,843 | A | 11/2000 | Pringle | |
| 6,206,645 | B1 | 3/2001 | Pringle | |
| 6,231,312 | B1 | 5/2001 | Pringle | |
| 6,305,402 | B2 | 10/2001 | Pringle | |
| 6,516,890 | B1 | 2/2003 | Jackson et al. | |
| 6,776,240 | B2 | 8/2004 | Kenison et al. | |
| 6,915,848 | B2 | 7/2005 | Thomeer et al. | |
| 2006/0137881 | A1 * | 6/2006 | Schmidt et al. | 166/372 |

FOREIGN PATENT DOCUMENTS

| | | | |
|---|---|---|---|
| GB | 2407335 | A | 4/2005 |

* cited by examiner

KICKOVER TOOL AND SELECTIVE MANDREL SYSTEM

BACKGROUND OF THE INVENTION

1. Field of the Invention

This invention relates to a kickover tool for use in installing apparatus, e.g. valves, in side pocket mandrels and for retrieving such apparatus.

2. Description of the Prior Art

Side pocket mandrels are used extensively in producing oil wells in connection with operations such as gas lift operations. These type mandrels are adapted to accommodate not only gas lift valves, but also various types well flow control devices, such as check valves, plugs, pilot valves, orifice valves, chemical injection valves, dummy valves, waterflood regulating valves, and control valves for various functions. These mandrels are referred to as "side pocket" mandrels, because the flow control device is housed in a pocket section that is offset from the main bore diameter. By having the offset pocket section, tools traveling up and down the hole are less likely to accidentally strike the flow control device. A tool striking the flow control device could damage or otherwise render it inoperative. The damaged flow control device would then have to be replaced, which an expensive and time consuming process during which the well would not be producing.

Tools which are used to insert, remove or otherwise interact with the well flow control devices in the side pocket mandrels are referred to as "kickover" tools. The kickover tool generally has an articulated arm assembly that is pivotally attached to an elongated tray and an orienting and trigger mechanism that cooperates with a slot and shoulder in an orienting sleeve with respect to the side pocket mandrel to release the arm assembly to pivot outwardly so that a flow control device coupled thereto can be inserted into the side pocket. Once the flow control device is latched in place, the arm assembly is released therefrom to permit the kickover tool to be removed from the well. Kickover devices and/or side pocket mandrels are illustrated and described in various U.S. Pat. Nos. 2,914,078; 3,086,593; 3,741, 299; 3,760,832; 3,874,445; 4,111,608; 4,239,082; 4,441,519; 4,541,482; 4,640,350; 4,976,314; 5,483,988; 5,862,859; 5,971,004, and 6,082,455.

It is common practice to connect a plurality of side pocket mandrels in a tubing string. One shortcoming associated with prior art kickover tools and side pocket mandrels is that no mechanism has heretofore existed to discriminate one side pocket mandrel from another, and the operator never knows for certain if the kickover tool is located at the appropriate side pocket mandrel when running the kickover tool into the bore. Another shortcoming associated with the prior art is the problem of being able to run and retrieve gas lift and waterflood valves in high angled deviated wells. Those shortcomings have been overcome with the apparatus of the present invention.

SUMMARY OF THE INVENTION

In accordance with the present invention, a kickover tool is provided for installing and retrieving a well flow control device from a side pocket mandrel in a wellbore. The kickover tool comprises a generally tubular-shaped housing, and a slider bar having proximal and distal ends which is inserted in and which is attached to the housing. In one embodiment, the attachment between the slider bar and the housing is advantageously effected by utilizing shear screws. Alternatively, the slider bar and the housing may be attached using shear pins or releasing dogs.

A kickover tool in accordance with the present invention additionally comprises a spring-loaded key which is cooperatively attached to the housing, and the spring-loaded key comprises a plurality of compression springs and has inner and outer circumferential surfaces. The inner circumferential surface of the spring-loaded key engages the slider bar when the compression springs are compressed to prevent the slider bar from moving. The outer circumferential surface of the spring-loaded key has a first predetermined machined pattern formed there.

A kickover tool in accordance with the present invention further comprises a spring-loaded dog which is cooperatively attached to the housing. The spring-loaded dog comprises a plurality of compression springs and also has inner and outer circumferential surfaces. The inner circumferential surface of the spring-loaded dog engages the slider bar when the compression springs are compressed and assists in preventing the slider bar from moving.

Apparatus in accordance with the present invention further comprises an articulated arm having two ends where one end is operatively coupled to the distal end of the slider bar and the other end is operatively coupled to well flow control device to be inserted in the side pocket mandrel.

A kickover tool in accordance with the present invention is inserted in a tubing string in a wellbore. The insertion of the kickover tool into the tubing string results in the outer circumferential surfaces of the spring-loaded key and the spring-loaded dog being depressed such that they are substantially aligned with the outer surface of the housing, which compresses the springs in the spring-loaded key and the spring-loaded dog.

At least one side pocket mandrel is connected in the tubing string, and each said side pocket mandrel has a diameter greater than the diameter of the tubing string. When the spring-loaded dog enters the side pocket mandrel, the outer circumferential surface of the spring-loaded dog moves out of alignment with the outer surface of the housing as the compression springs in the dog return to their free lengths. Each side pocket mandrel comprises an orientation sleeve which the spring-loaded dog then engages to rotate the slider bar of the kickover tool into a proper position for deployment of the articulated arm.

Each side pocket mandrel further comprises a profile having a predetermined machined pattern which the spring-loaded key engages, if the predetermined machined pattern on the outer circumferential surface of the spring-loaded key matches the predetermined machined pattern in the profile. In that event, the spring-loaded key no longer prevents the slider bar from moving, and the slider bar may be moved downhole, once external forces are applied to the slider bar to break its attachment to the housing. The articulated arm is then deployed, and the well flow control device is inserted in the side pocket of the side pocket mandrel. If the predetermined machined pattern on the outer circumferential surface of the spring-loaded key does not match the machined pattern on the profile, the kickover tool continues down the tubing until the machined pattern on the spring-loaded key matches the profile in a side pocket mandrel.

Thus, in accordance with the present invention, a system is provided for using a kickover tool to install a well control device in the side pocket of a side pocket mandrel in a wellbore. This system comprises a tubing string having at least one side pocket mandrel for receiving a well flow control apparatus where the side pocket mandrel has a profile machined therein which has a first predetermined pattern. A system in accordance with the present invention further comprises a kickover tool having an articulated arm and a key, where the key has a second predetermined machined pattern. The articulated arm of the kickover tool is permitted to deploy when the second machined pattern on the key matches the first predetermined machined pattern in the profile of the side pocket mandrel.

In accordance with the present invention, a method of using a kickover tool to install a well flow control device in the side pocket of the side pocket mandrel is provided. This method comprises establishing a key on the kickover tool having a first predetermined machined pattern and establishing a profile in the side pocket mandrel where the profile has a second predetermined machined pattern. A method according to the present invention further comprises the step of allowing the kickover tool to deploy to install the well flow control device when the first predetermined machined pattern matches the second predetermined machined pattern.

DESCRIPTION OF SPECIFIC EMBODIMENTS

It will be appreciated that the present invention may take many forms and embodiments. In the following description, some embodiments of the invention are described and numerous details are set forth to provide an understanding of the present invention. Those skilled in the art will appreciate, however, that the present invention practiced without those details and that numerous variations from and modifications of the described embodiments may be possible. The following description is thus intended to illustrate and not to limit the present invention.

Figure 1:
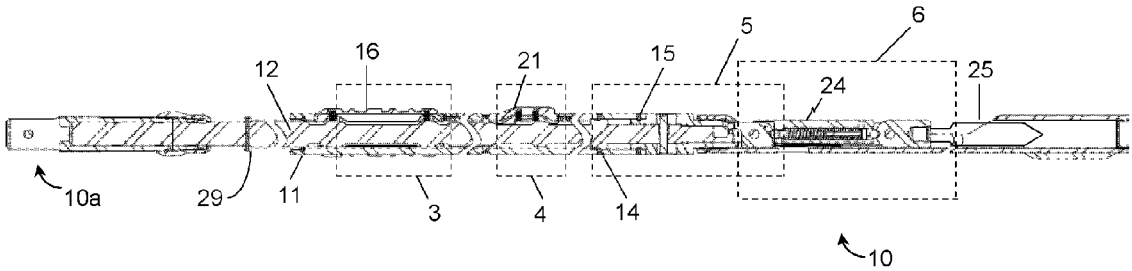
FIG. 1 is a cross-sectional view along the longitudinal axis of kickover tool apparatus in accordance with the present invention.
Figure 5:
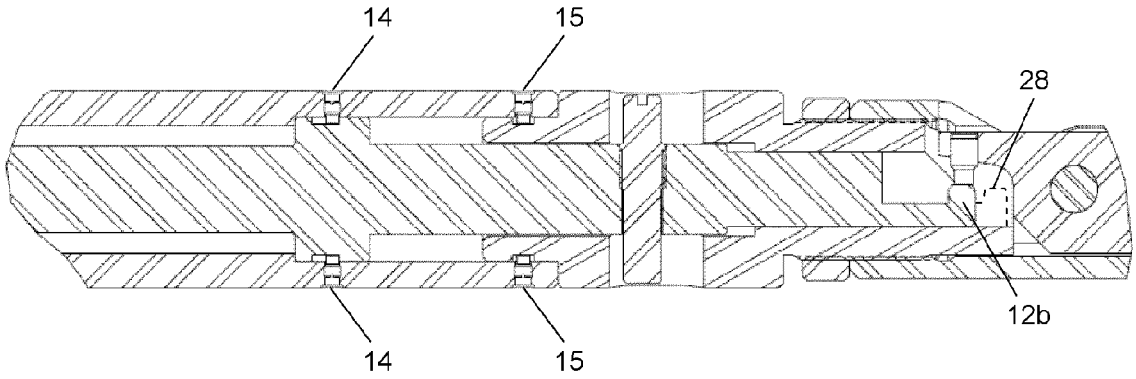
FIG. 5 is an enlarged cross-sectional view of the orienting sleeve of FIG. 1 which is contained in box 5 in FIG. 1.

With reference first to FIG. 1, there is illustrated a kickover tool 10 in accordance with the present invention. Kickover tool 10 comprises a housing 11 which is generally tubular-shaped and slider bar 12. Slider bar 12 is inserted in housing 11 and is attached to housing 11. As illustrated in FIGS. 1 and 5, the attachment of slider bar 12 to housing 11 is made in one embodiment by using two sets of shear screws 14 and 15, where each set of shear screws 14 and 15 comprises a plurality of screws which are located around the periphery of housing 11.

Figure 3:
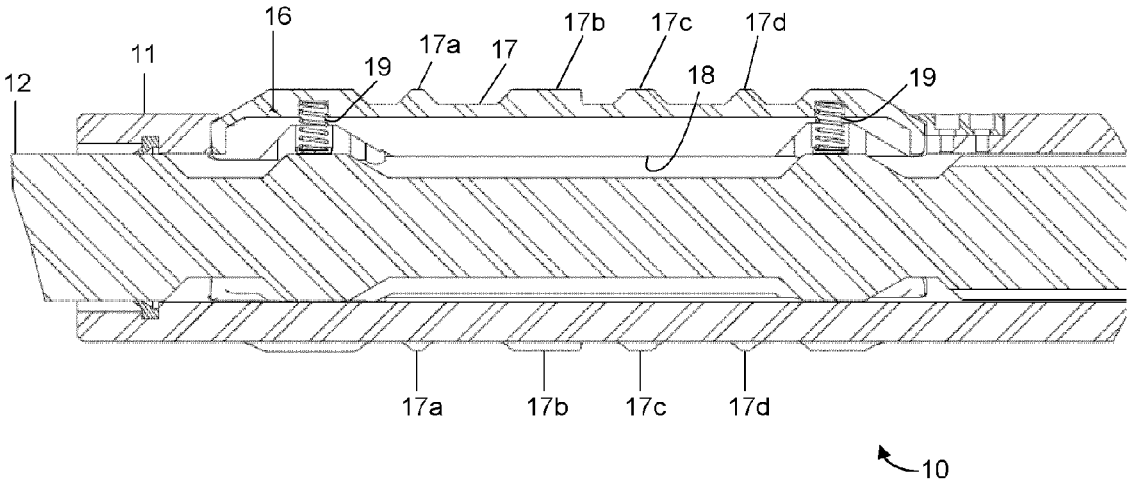
FIG. 3 is an enlarged cross-sectional view of that portion of the apparatus of FIG. 1 which is contained in box 3 in FIG. 1.

With reference now to FIGS. 1 and 3, kickover tool 10 according to the present invention comprises a spring-loaded key 16, having an outer circumferential surface 17 comprising a plurality of machined patterns 17*a*-17*d*. Spring-loaded key 16 also comprises an inner circumferential surface 18 which mates with the slider bar 12 (see FIG. 3) and prevents slider bar 12 from moving, when compression springs 19 are compressed.

Figure 4:
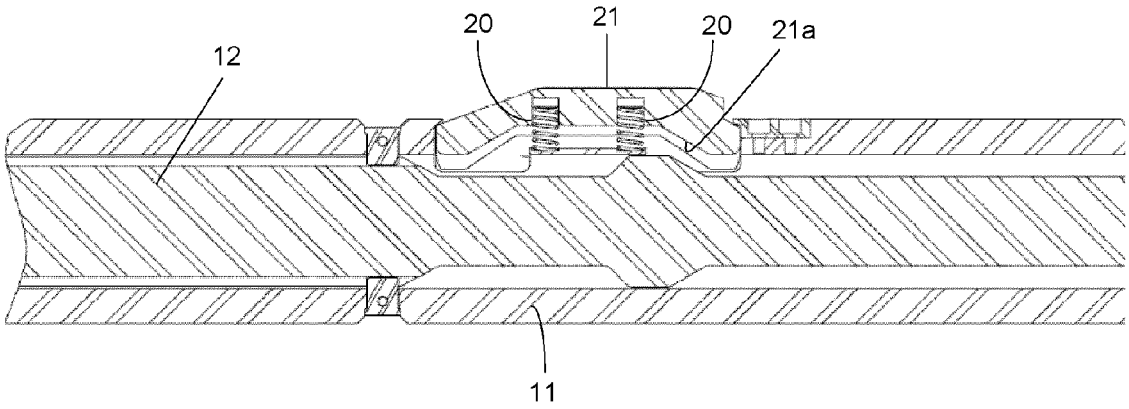
FIG. 4 is an enlarged cross-sectional view of that portion of the apparatus of FIG. 1 which is contained in box 4 in FIG. 1.

With reference now to FIGS. 1 and 4, kickover tool 10 in accordance with the present invention further comprises a spring-loaded dog 21. When compression springs 20 are compressed, the inner surface 21*a* of spring-loaded dog 21 is in contact with the slider bar 12 and assists in restraining slider bar 12 from moving.

Figure 6:
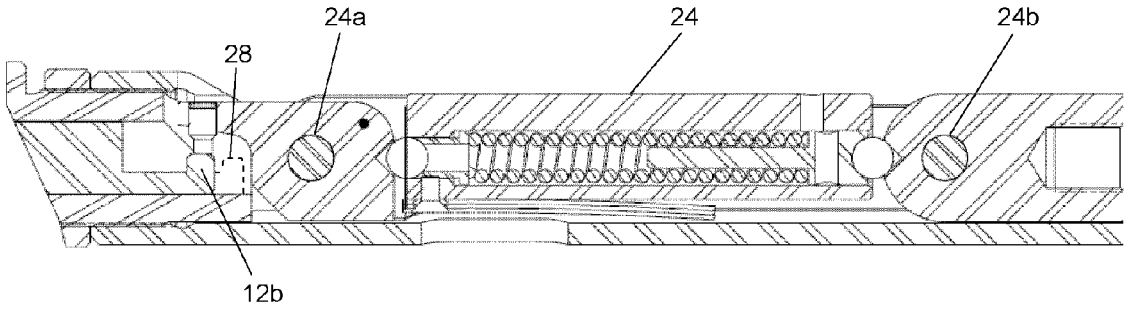
FIG. 6 is an enlarged cross-sectional view of the articulated arm of the kickover tool as illustrated in FIG. 1 and as contained in box 6 of FIG. 1.

With reference to FIGS. 1 and 6, a kickover tool 10 in accordance with the present invention utilizes an articulating arm 24 such as is employed in a standard kickover tool as provided by Schlumberger, the assignee of the present invention and of this application. Articulating arm 24, when deployed, pivots about pins 24*a* and 24*b*. A well flow control device 25 is attached to the distal end 10*b* of articulating arm 24 for installation in side pocket 34.

Figure 2:
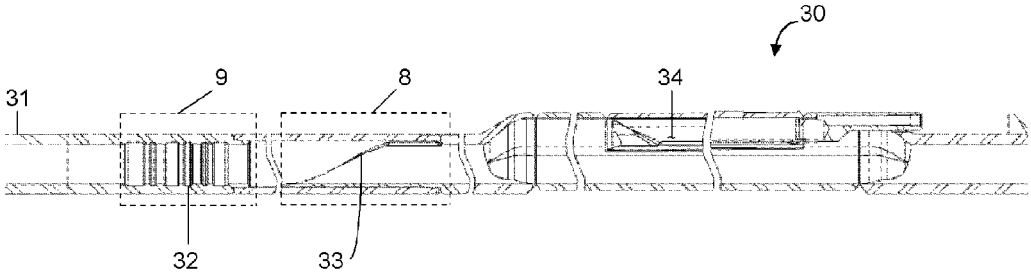
FIG. 2 is a cross-sectional view of that portion of a side pocket mandrel in accordance with the present invention.
Figure 8:
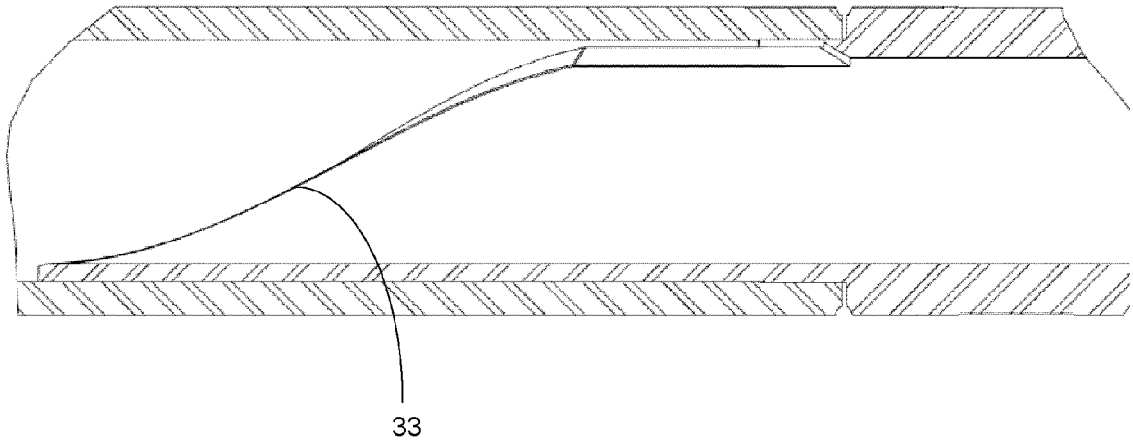
FIG. 8 is an enlarged cross-section view of the orienting sleeve as contained in box 8 in FIG. 2.
Figure 9:
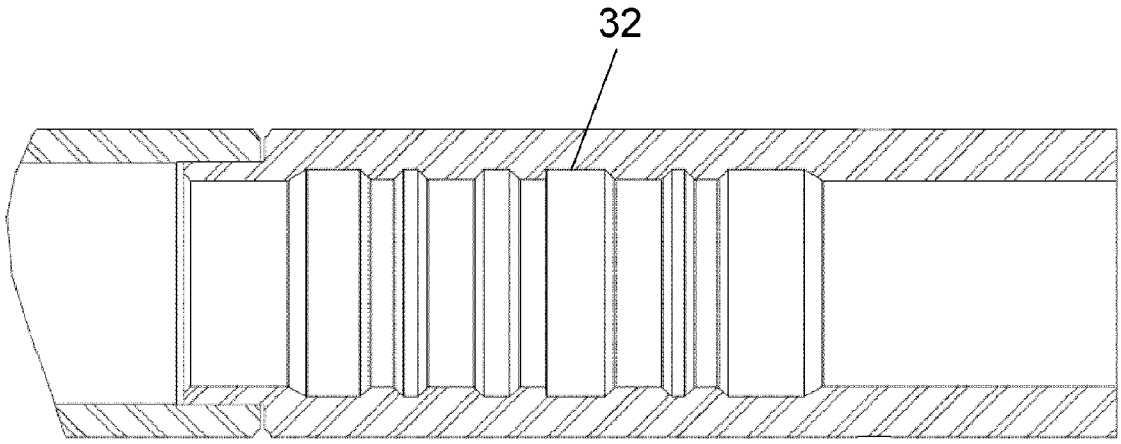
FIG. 9 is an enlarged cross-sectional view of the profile in box 9 in FIG. 2.

With reference now to FIGS. 2, 8 and 9, a side pocket mandrel 30 in accordance with the present invention is illustrated. Side pocket mandrel 30 is installed as part of a tubing string 31. Side pocket mandrel 30 comprises a profile 32 as illustrated in FIGS. 1 and 9, and profile 32 comprises a predetermined machined pattern. Orienting sleeve 33 to ensure that the kickover tool is properly oriented for deployment, as discussed below. Side pocket mandrel 30 also comprises a side pocket in which well flow control device 25 may be installed.

In operation, the distal end 10*b* of kickover tool 10 is inserted into the tubing string 31. The diameter of tubing string 31 is only slightly larger than the diameter of housing 11 of kickover tool 10. Accordingly, the lower circumferential surface 18 of spring-loaded key 16 is forced into contact with slider bar 12. This causes compression springs 19 (FIG. 3) to compress and spring-loaded key 16 assists in preventing slider bar 12 from moving. Similarly, the difference in diameter between tubing string 31 and housing 11 is such that the lower circumferential surface 21 a of dog 21 is in contact with the slider bar, thereby causing compression springs 20 to compress.

The inside diameter of side pocket mandrel 30 is larger than the inside diameter of tubing string 31. Thus, when spring-loaded dog 21 enters side pocket mandrel 30, the compression springs 20 will return to their free lengths forcing dog 21 into the position shown in FIG. 4. Spring-loaded dog 21 then engages orienting sleeve 33 to ensure that the articulating arm 24 is in the proper position for deployment of the well flow control device. Similarly, when spring-loaded key 16 enters the side pocket mandrel 30, the compression springs 19 will attempt to return to their free lengths and will do so if the predetermined machined pattern on the upper circumferential surface 17 of spring-loaded key 16 matches the predetermined machined pattern in profile 32 of side pocket mandrel 30. In that event, spring-loaded key 16 no longer prevents slider bar 12 from moving.

Figure 7:
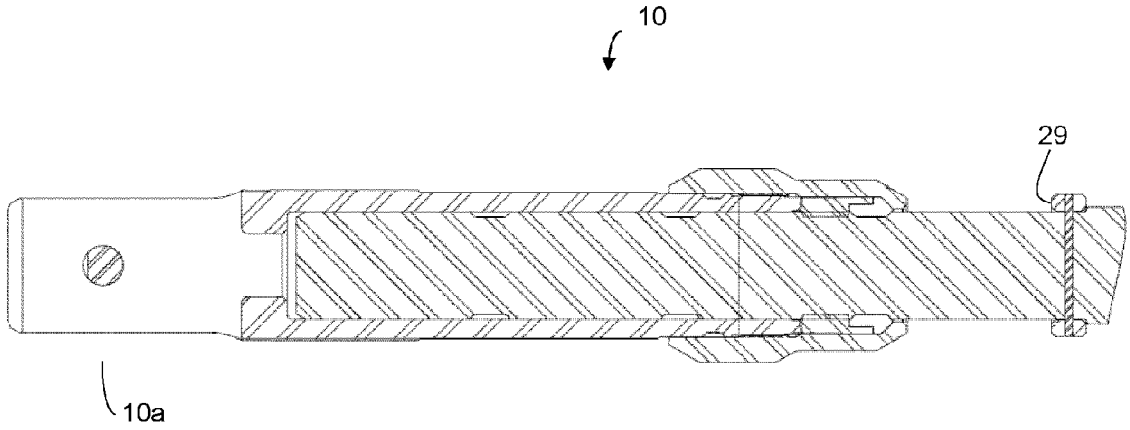
FIG. 7 is a cross-sectional view of the proximal end of the kickover tool illustrated in FIG. 1.

A sufficient external force may then be applied to the proximal end 10*a* of kickover tool 10 to cause the slider bar 12 to break its attachment to housing 11. In one embodiment, the attachment of slider bar 12 to housing 11 is broken by applying force which causes shear screws 14 to shear. When this occurs, the slider bar moves downward, and, is illustrated in FIGS. 5 and 6, end 12*b* of slider bar 12 moves to the position shown by the dotted line 28. When this occurs, the kickover of the articulated arm 24 is initiated. Force is continued to be applied to the proximal end 10*a* of kickover tool 10 until the second set of shear screws 15 is sheared. At this time, the well flow control device 25 may be inserted into the side pocket 34 of side pocket mandrel 30. Ring 29 (FIGS. 1 and 7) is sheared by housing 11 when the well flow control device 25 is in the correct position in the side pocket. Once the well flow control device 25 is latched into the side pocket 34, a pulling force on the kickover tool will pull it back into the original position which allows the spring-loaded key 16 to dislodge from the profile 32 and, thereby allowing the kickover tool 10 to be retrieved from the wellbore.

The same steps as described above may be used for retrieving the well flow control device from the side pocket, except that the downward force and stroke on the kickover tool after the spring-loaded key 16 is locked into profile 32 would be used to latch onto the well flow control device, and a pull on the kickover tool would retrieve the well flow control device out of the pocket.

A kickover tool in accordance with the present invention is expected to provide a solution to the problem of being able to run and retrieve gas lift, waterflood and chemical injection valves in high angled deviated wells. When a kickover tool in accordance with the present invention is used in such a well, it is believed that it would be advantageous to deliver the kickover tool into the wellbore using coiled tubing which will enable the kickover tool to be pushed into high angled deviated wells. However, a kickover tool in accordance with the present invention is not limited to use in high angled deviated wells or to use with a coiled tubing deployment system. Other deployment mechanisms besides coiled tubing that may be used for running a kickover tool of the present invention into a wellbore include tractor, wireline, spaghetti tubing, and joint pipe. Accordingly, the appended claims are not limited to any specific deployment mechanism.

What is claimed is:

1. A kickover tool for installing and retrieving a well flow control device from a side pocket mandrel in a wellbore, comprising:

a generally tubular-shaped housing;

a slider bar having proximal and distal ends which is inserted in and releasably attached to said housing;

a spring-loaded key which is cooperatively attached to the housing, where the spring-loaded key comprises a plurality of springs and has inner and outer circumferential surfaces, the inner circumferential surface of the spring-loaded key engaging the slider bar when the springs are compressed to prevent the slider bar from moving and the outer circumferential surface of the spring-loaded key having a predetermined machined pattern formed therein;

a spring-loaded dog which is cooperatively attached to the housing, where the spring-loaded dog comprises a plurality of springs and has inner and outer circumferential surfaces, the inner circumferential surface of the spring-loaded dog engaging the slider bar when the springs are compressed to assist in preventing the slider bar from moving; and an articulated arm having two ends where one end is operatively coupled to the distal end of the slider bar and the other end is operatively coupled to the well flow control device to be inserted in the side pocket mandrel.

2. The apparatus of claim 1, further comprising:

a tubing string in a wellbore into which the kickover tool is inserted, said insertion causing the springs in the spring-loaded key and spring-loaded dog to be compressed; and at least one side pocket mandrel connected in said tubing string, said side pocket mandrel having an inner diameter greater than the inner diameter of the tubing string and comprising:

(i) an orientation sleeve which the spring-loaded dog engages to rotate the slider bar of the kickover tool into a position for deployment of the articulated arm; and (ii) a profile comprising a predetermined machined pattern for engagement with the spring-loaded key, if the pattern on the outer circumferential surface of the spring loaded key matches the profile, said engagement permitting the slider bar to move;

(iii) a side pocket for insertion of the well flow control device.

3. The apparatus of claim 2, wherein the well flow control device is selected from the group consisting of check valves, pilot valves, gas lift valves, orifice valves, chemical injection valves, dummy valves, waterflood valves and plugs.

4. The apparatus of claim 2, wherein the slider bar is releasably attached to the housing using shear screws, shear pins or releasing dogs.

5. The apparatus of claim 2, wherein the slider bar moves to break its attachment to the housing after the spring-loaded key engages the profile.

* * * * *